US006474448B1

(12) United States Patent
Zappa

(10) Patent No.: US 6,474,448 B1
(45) Date of Patent: Nov. 5, 2002

(54) MODULAR LOCK FOR ELEVATOR DOORS

(75) Inventor: Roberto Zappa, Osio Sotto (IT)

(73) Assignee: Sematic Italia S.p.A., Bergamo (IT)

( * ) Notice: Subject to any disclaimer, the term of this patent is extended or adjusted under 35 U.S.C. 154(b) by 0 days.

(21) Appl. No.: 09/617,671

(22) Filed: Jul. 17, 2000

(30) Foreign Application Priority Data

Jan. 26, 2000 (IT) ..... MI2000A99

(51) Int. Cl.[7] ..... B66B 13/06

(52) U.S. Cl. ..... 187/339; 187/324; 187/325; 187/330; 187/331; 187/308; 187/309; 187/310

(58) Field of Search ..... 187/324, 325, 187/333, 339, 331, 330, 308, 309, 310

(56) References Cited

U.S. PATENT DOCUMENTS 2,287,751 A * 6/1942 Fenn ..... 187/31
5,730,254 A * 3/1998 Nguyen ..... 187/335

* cited by examiner

*Primary Examiner*—Eileen D. Lillis
*Assistant Examiner*—Michael Lowe
(74) *Attorney, Agent, or Firm*—Bucknam and Archer

(57) ABSTRACT

A modular lock (10) for elevator doors, in particular for locking and unlocking the floor doors of elevators and hoists, comprises a first fixed plate (12) and a second plate (14) articulated on the same, cooperating with the blades of the car activator and provided with means (52, 62) for striking a contact (48, 56).

3 Claims, 2 Drawing Sheets

MODULAR LOCK FOR ELEVATOR DOORS

DESCRIPTION

The present invention relates to a modular lock for elevator doors.

More particularly, the present invention relates to a modular lock for locking the floor doors of elevators and hoists, suitable to be combined with devices different from each other according to the safety or protection norms of the electric parts.

As is known, in the elevator and hoist systems, specific locking and unlocking doors are provided for each of the doors located at the different floors; such locks that have a tilting working, are provided with wheels or rollers that are stricken by the conventional blades mounted on the car activator. When said blades get in touch with the wheels—substantially in coincidence with the arrival of the car at the floor—the lock tilts and its hook disengages from the key-way, allowing therefore the opening of the doors.

According with the laws in force for the safety or protection of electric parts, the locks of the floor doors must have specific and different characteristics; in particular, the differences concern the electric contacts of the locks which are markedly different from each other with respect to the structure, depending on their being of the water- and powder-proof type or also of the explosion-proof type. The first ones further differ from each other according to the protection level required, which varies according to the characteristics of the environment where the elevator is installed; the variables, for instance, are constituted by the concentration of powders in the air, the exposure to water of the elevators—if they are installed in the open or if they are of the panoramic type—, by the size of the holes through which the contacts are reached. Because of these variables, there are traditionally used different types of locks, provided generally with as many different locking-unlocking combinations or systems.

As a consequence, also the car must be equipped with complementary specific hooking devices.

All this involves severe drawbacks, caused by the need of preparing many non-standardized locks, with the associated increase in the production costs. As a consequence, the drawback affects the management of spare parts, for which a storehouse must be provided to store a big stock of locks. A further drawback of the known locks for the elevator floor doors concerns their structural complexity, which causes a further increase in the costs and difficulties during maintenance or repairs.

Object of the present invention is to obviate the above drawbacks.

More particularly, object of this invention is to realize a modular lock for elevator floor doors to which it is possible to alternatively associate electric contacts of different type and/or function, keeping substantially unaltered the structure of said lock.

A further object of the invention is to realize a modular lock wherein said contacts are alternatively applied in a simple and quick manner.

A further object of the invention is to realize a modular lock provided with common locking-unlocking devices also in the presence of contacts of a different type.

A further object of the invention is to provide users with a modular lock for elevator floor doors suitable to ensure a high level of resistance and reliability in the time, and also such as to be realized easily and economically.

These and still other objects are achieved by the modular lock for elevator floor doors, in particular for the locking-unlocking of floor doors of elevators and hoists, comprising a first fixed plate and a second plate articulated on the same and cooperating with the blades of the car activator, and provided contact striking means.

The construction and functional characteristics of the modular locks for elevator floor doors of the present invention will be better understood thanks to the following description wherein reference is made to the attached drawings that represent a preferred, non-limiting embodiment, and wherein.

Figure 1:
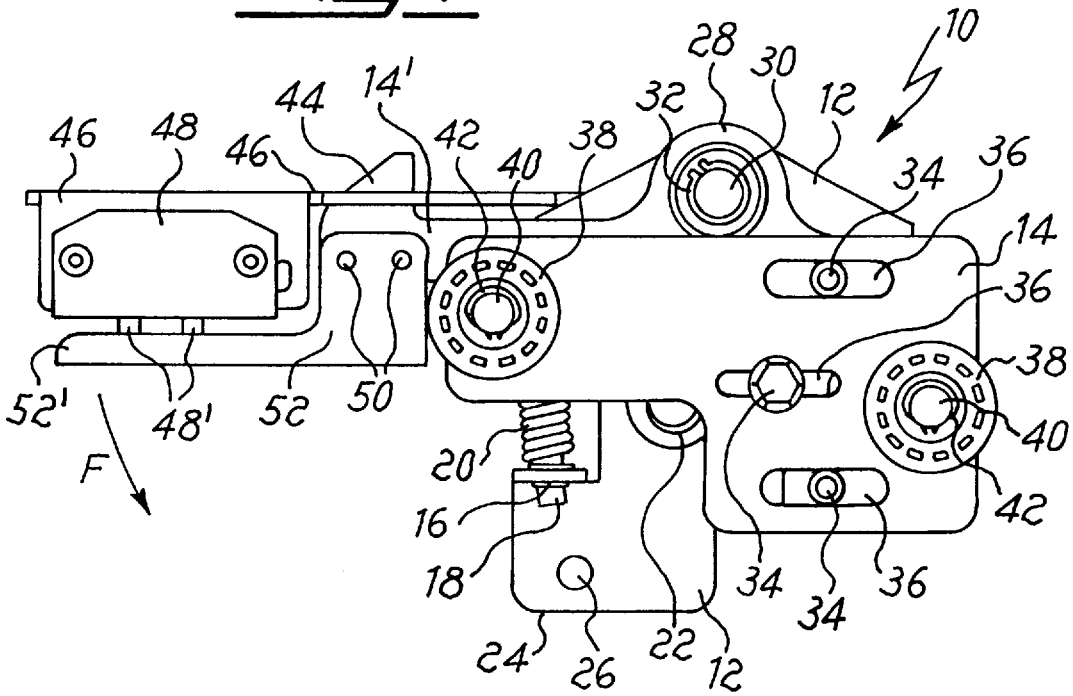
FIG. 1 shows schematically in front view the modular lock of the present invention to which there is associated, by way of example, an electric contact with a low level of protection from water and powder.

With starting reference to FIG. 1, the modular lock of the present invention, indicated as a whole by 10, comprises a first base plate 12, from metal or other suitable materials, and a second plate 14 fixed to a third plate or lock bolt 14'; the second plate 14 and the lock bolt 14' are tied to each other, which will be described later on. Said plate 12 is laterally provided with a seat 16 for housing a pin or spring guide 18 or the like whereon a spring 20 is fitted on, as well as an element from elastic material 22 that protrudes from its front and constitutes the shock absorber stricken by the third plate 14', as will be specified later on.

The configuration of the first plate 12 is, by way of example, polygonal and irregular, with a trapezoid upper part wherefore a shaped extension 24 develops on a side and downwards that integrates seat 16 for the spring guide 18 and for element 22. The same plate 12 has one or more through-holes 26 for the insertion of screws or like means suitable for its stable fixing to the floor door.

Figure 3:
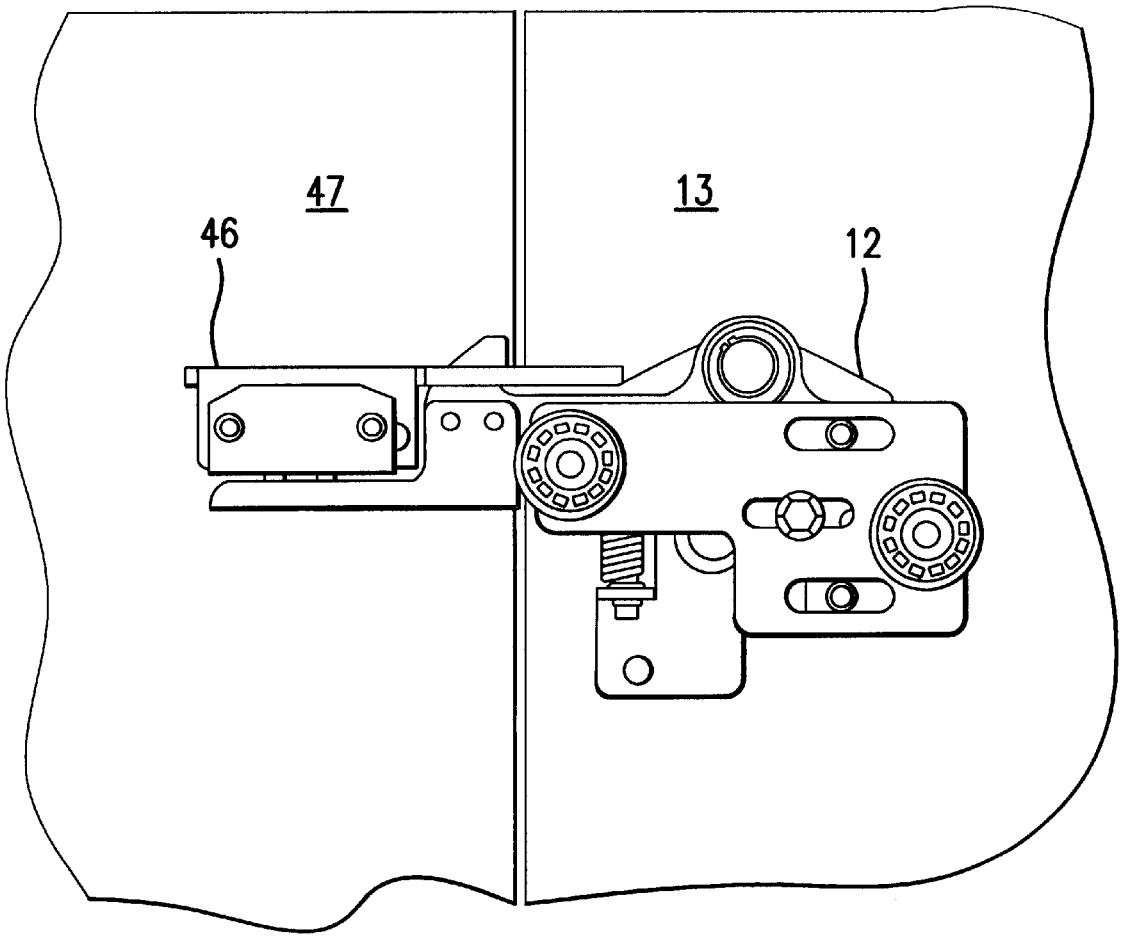
FIG. 3 shows the modular lock of FIG. 1 installed on a pair of side by side elevator doors.

13 of a pair of side by side floor doors 13 and 47, as shown in FIG. 3.

The second plate 14, also from metal or other suitable material, has preferably a substantially down-laying "L" shape, fixed by means of screws 34 to plate 14' which bears an integral extension 28 which couples with pin 30, integral, in its turn, with plate 12. Said extension, for instance of a substantially circular shape is drilled in the middle to house said pin 30 or the like protruding from the front of the first plate 12; the second plate 14 is fitted on the first plate 12, starting from extension 28 from whose central hole pin 30 protrudes. The latter is provided with a widening for housing an elastic ring 32 that realizes the superposed connection of said plates. Two or more screws 34 further connect plate 12 to the second plate 14; for this purpose, the second plate 14 is provided with slots 36 for guiding said screws. Thanks to this connection, plate 14 and lock bolt 14' can tilt with respect to the underlying plate 12.

Two suitably spaced wheels or rollers 38 are applied to the front of the second plate 14, suitable to be stricken by the conventional blades mounted on the car activator (not shown); wheels 38 are, for instance, fitted on pins 40 protruding from the front of the second plate 14, tied to said pins in a known manner, with elastic rings 42 or the like. The spring guide 18 for spring 20 is tied to the back of said plate or lock bolt 14' in substantial alignment with seat 16 of the first plate. At the free end of plate or lock bolts 14' an integral shaped extension 44 forms a hook that engages with the key-way of the lock, indicated by 46, fixed on the floor door 47 of the pair of side by side floor doors 13 and 47, as shown in FIG. 3. Extension 44 is suitable to fit in a slit obtained in said lock bolt of the floor door when the car is moving, to prevent the opening of the floor doors; contact 48 is fixed to said key-way 46, which contact, in the embodiment of FIG. 1, is an electric contact without a high level of protection from water and powder, with circuit opening and closing terminations 48. Beyond the shaped extension or hook 44, a shaped plate 52 is tied to said lock bolt 14' that is suitable to bear the removable bridge 48' of contact 48 and to move away alternatively from the same. In the embodiment of FIG. 1, plate 52 is provided with an integral rectilinear orthogonal oriented branch 52'.

During the running of the elevator system, when the car reaches the floor, the blades mounted on the car activator strike wheels 38 of the second plate 14, causing the tilting of the same and the lock bolt 14' with respect to the underlying first plate 12; in particular said tilting movement takes place in the direction indicated by arrow "F",' with its fulcrum on pin 30. Hook 44 disengages from the slit of the lock bolt 46 and plate 52, connected to the second plate 14 and the lock bolt 14', moves away with its own branch 52' from contact 48, opening the circuit and causing the opening of the floor doors; during this step, spring 20 is compressed.

Vice-versa, when the electric impulse is supplied again to cause again the running of the car, the activator blades move away from wheels 38 and spring 20 releases, so that hook 44 enters the slit of the lock bolt 46 and plate 52 strikes contact 48 with its own branch 52', closing the circuit.

Figure 2:
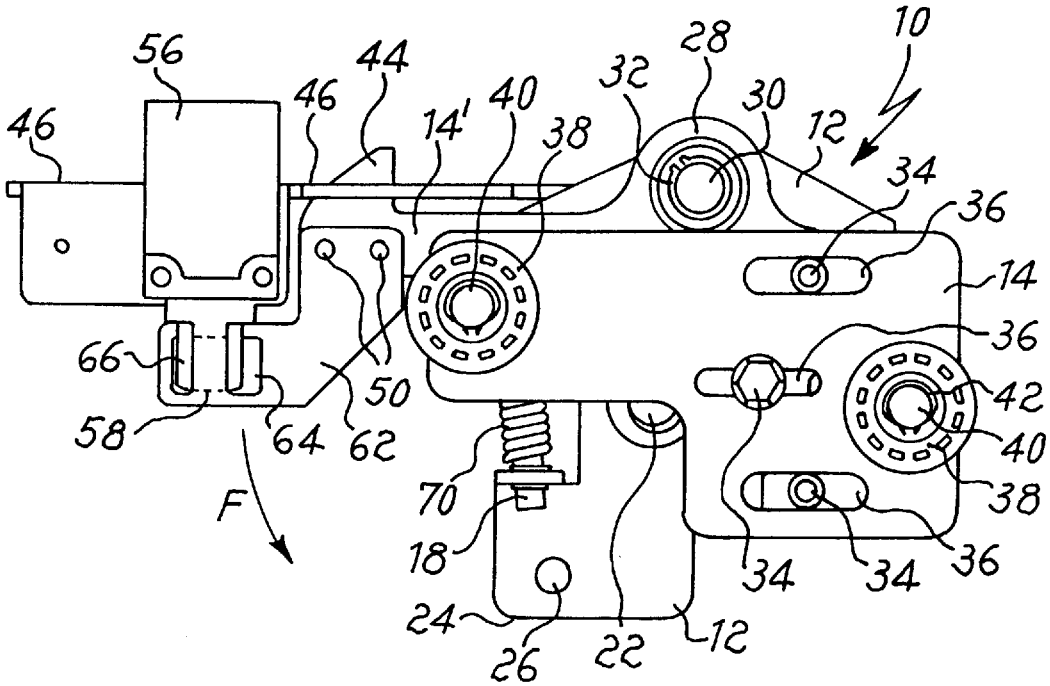
FIG. 2 shows schematically in front view the same lock provided with a contact of the explosion-proof type or, alternatively, with a contact with a high level of protection from water and powder.

FIG. 2 represents the same lock 10 equipped with a contact of the explosion-proof type or alternatively with a contact of the water- and powder-proof type; in said figure the same numbers of the preceding figure are used to indicate like parts. In this embodiment—the configuration and the general structure of plates 12, 14, 14' being the same—lock 10 is provided with a plate specifically shaped for the interaction with the contact of the explosion-proof type or alternatively with the contact of the water- and powder-proof type, indicated by 56 and without electric terminations. Contact 56 has on the lower front a downwards protruding extension 58, intended for interacting with an electric release cam 66, suitably connected in the inside of contact 56. The plate that interacts with contact 56, indicated by 62, has a substantially triangle configuration and is fixed with rivets 50, like plate 52 of FIG. 1, to the lock bolt 14', beyond hook 44. Along the branch intended for striking extension 58 of contact 56, plate 62 has an aperture 64, intended for cooperating with said cam 66.

During the running, the lock is tiltingly moved in the same way as the solution described above with respect to contact 48; the lowering of the second plate 14 and the lock bolt 14' in the direction of arrow "F" causes the disengagement of hook 44 from the lock bolt 46 and that of plate 62 from extension 58 of the explosion-proof contact 56 or alternatively of the water- and powder-proof contact. In this case, the spring fitted on pin 18, indicated by 70, has a greater compression resistance than spring 20, having to support a higher load according to the type of contact present on lock 10, i.e. an explosion-proof contact or alternatively a water- and powder-proof contact without electric terminations.

As can be inferred from the above, the advantages achieved by the invention are obvious.

Thanks to its general structure and the presence of specific plates 52, 62, the lock of the present invention can be advantageously used for electric contacts that have a different protection level or are explosion-proof, changing only a minimum part of its components.

Besides contact 48 or 56, it is in fact sufficient to tie to the second plate 14 a plate 52 or 62 and utilize a spring 20 or 70, without changing the other components. This standardization involves significant savings both of production and of management of the spare parts, and renders also easier maintenance and repairs.

The invention, as has been described above and as is claimed in the following has been however proposed by way of non-limiting examples, being understood that the same is susceptible of many modifications and variants, all of which fall within the scope of the inventive concept.

What is claimed is:

1. A modular lock (10) for elevator doors, in particular for locking and unlocking the floor doors of elevators and hoists, comprising:

a first plate (12) fixed to a first floor door and having a pin (30) extending from an upper part thereof;

a lock bolt (14') having an integral extension (28) in an upper part thereof provided with a through hole for articulation on said pin (30), said pin (30) having a widening for housing an elastic ring (32) so as to maintain said lock bolt (14') on said pin (30), said lock bolt (14') having a shaped extension (44) in the form of a hook provided in an upper part thereof;

a second plate (14) cooperating with the blades of a car activator is fixed to said lock bolt (14') by means of screws (34) passing through slots (36) in said second plate (14), said second plate (14) including a shaped plate (52) fixed thereto and extending beyond the shaped extension (44) of lock bolt (14') with a rectilinear branch (52');

a lock key-way (46) fixed to a second floor door and having a slit therein for engagement by shaped extension (44) and supporting a contact (48) the electric terminations (48') of which being supported on rectilinear branch (52') of shaped plate (52); and a spring (20) is disposed between second plate (14) and first plate (12) for opposing the tilting of said second plate (14) with respect to said first plate (12) about pin (30).

2. The modular lock according to claim 1, wherein the first plate (12) is provided with one or more through-holes (26) for the insertion of screws suitable for its fixing on the first floor door.

3. The modular lock according to claim 1, wherein wheels (38) are fitted on and tied to pins integral with the second plate (14).

* * * * *